US012259219B2

(12) United States Patent
Maryfield et al.

(10) Patent No.: US 12,259,219 B2
(45) Date of Patent: Mar. 25, 2025

(54) ENHANCED MULTI-PURPOSE FIRE CONTROL CLIP-ON RIFLESCOPE DISPLAY

(71) Applicant: Cubic Corporation, San Diego, CA (US)

(72) Inventors: Tony J. Maryfield, Poway, CA (US); Mahyar Dadkhah, San Diego, CA (US); Christian Marcello Cugnetti, San Diego, CA (US); Brian Kent Somers, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 18/322,515

(22) Filed: May 23, 2023

(65) Prior Publication Data

US 2023/0384058 A1 Nov. 30, 2023

Related U.S. Application Data

(60) Provisional application No. 63/345,319, filed on May 24, 2022.

(51) Int. Cl.

| | |
|---|---|
| ***F41G 3/08*** | (2006.01) |
| ***F41G 3/06*** | (2006.01) |
| ***F41G 11/00*** | (2006.01) |

(52) U.S. Cl.

CPC ..... *F41G 3/08* (2013.01); *F41G 3/06* (2013.01); *F41G 11/003* (2013.01)

(58) Field of Classification Search

CPC . F41G 3/08; F41G 3/06; F41G 11/003; F41G 1/38; F41G 1/473

See application file for complete search history.

(56) References Cited

U.S. PATENT DOCUMENTS

| | | | | |
|---|---|---|---|---|
| 8,363,321 | B1 | 1/2013 | Pochapsky | |
| 10,495,417 | B1 * | 12/2019 | Geissele | F41G 11/003 |
| 2005/0039370 | A1 | 2/2005 | Strong | |
| 2006/0254116 | A1 | 11/2006 | Holmberg | |
| 2014/0110482 | A1 * | 4/2014 | Bay | F41G 1/44 235/404 |
| 2016/0223293 | A1 * | 8/2016 | Maryfield | F41G 11/00 |
| 2018/0252500 | A1 * | 9/2018 | Maryfield | F41G 1/38 |
| 2022/0120533 | A1 * | 4/2022 | Teetzel | F41G 1/473 |

FOREIGN PATENT DOCUMENTS

WO 2017180744 A1 10/2017

* cited by examiner

*Primary Examiner* — Sonji N Johnson

(74) *Attorney, Agent, or Firm* — MUGHAL GAUDRY & FRANKLIN PC

(57) ABSTRACT

A fire-control display adapter for a weapon scope. The fire-control display adapter consists of a display unit positioned at the scope's objective bell and aligned in front of the scope's objective lens. A range finder calculates the distance from a target's aimpoint. A ballistic computer is communicably coupled to both the display unit and the distance sensor. The ballistic computer computes a ballistic solution and causes the display unit to display it. To power to the distance sensor and the display unit, a power source is communicably coupled to the ballistic computer. A mount detachably secures the fire-control display adapter to the weapon's rail.

20 Claims, 10 Drawing Sheets

ENHANCED MULTI-PURPOSE FIRE CONTROL CLIP-ON RIFLESCOPE DISPLAY

CLAIM OF PRIORITY

This application claims the benefit of and is a non-provisional of co-pending U.S. Provisional Application Ser. No. 63/345,319 filed on May 24, 2022, which is hereby expressly incorporated by reference in its entirety for all purposes.

BACKGROUND

This disclosure generally relates to display adapters and, not by way of limitation, to a scope of a weapon.

A scope for rifles is an optical sighting device that is mounted on a rifle to aid in aiming and accuracy. The use of scopes has become increasingly popular in hunting, target shooting, and military applications. Scopes for rifles are typically designed with a reticle or crosshairs that are used to aim at the target and can provide varying degrees of magnification depending on the intended use.

SUMMARY

In one embodiment A fire-control display adapter for a weapon scope. The fire-control display adapter consists of a display unit positioned at the scope's objective bell and aligned in front of the scope's objective lens. A range finder calculates the distance from a target's aimpoint. A ballistic computer is communicably coupled to both the display unit and the distance sensor. The ballistic computer computes a ballistic solution and causes the display unit to display it. To power to the distance sensor and the display unit, a power source is communicably coupled to the ballistic computer. A mount detachably secures the fire-control display adapter to the weapon's rail.

In another embodiment, a fire-control display adapter for a scope of a weapon is disclosed. The fire-control display adapter comprises a display unit positioned at an objective bell of the scope and aligned in front of an objective lens of the scope. The fire-control display adapter further comprises a distance sensor to sense a range to an aimpoint of a target. A ballistic computer is communicably coupled to the display unit and the distance sensor to calculate a ballistic solution and cause the display unit to display the ballistic solution. A power source is communicably coupled to the ballistic computer to provide power to the distance sensor and the display unit. A mount detachably secures the fire-control display adapter on the rail of the weapon. The mount includes an adjuster to adjust the fire-control display adapter with respect to an optical path and/or an ocular lens of the scope.

In still embodiment, a fire-control display adapter for a scope of a weapon is disclosed. The fire-control display adapter comprises a display unit positioned at an objective bell of the scope and aligned in front of an objective lens of the scope. A sealing ring is detachably coupled to the display unit. A distance sensor senses a range to an aimpoint of a target. A ballistic computer is communicably coupled to the display unit and the distance sensor to calculate a ballistic solution and causes the display unit to display the ballistic solution. A power source is communicably coupled to the ballistic computer to provide power to the distance sensor and the display unit. A mount detachably secures the fire-control display adapter on a rail of the weapon.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a second alphabetical label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Embodiments described herein are generally related to fire-control display adapters for a scope of a weapon. In particular, some embodiments of the disclosure describe assisting in shooting a target. The assistance is provided by generating a ballistic solution and displaying the ballistic solution on a display unit. The display unit is configured such that a user can see information associated with the ballistic solution as an overlay on the objective lens while the user is looking at a target through an ocular lens of the scope. The user can then have a shot at the target by adjusting the position of the weapon according to the ballistic solutions displayed on the display unit.

The presentation of the ballistic solution as the overlay on the objective helps a shooter to adapt to an appropriate shooting position on a battlefield to shoot the target with accuracy while considering environmental conditions, such as range to the target, wind speed, temperature, atmospheric pressure, elevation, cant, etc.

Figure 1:
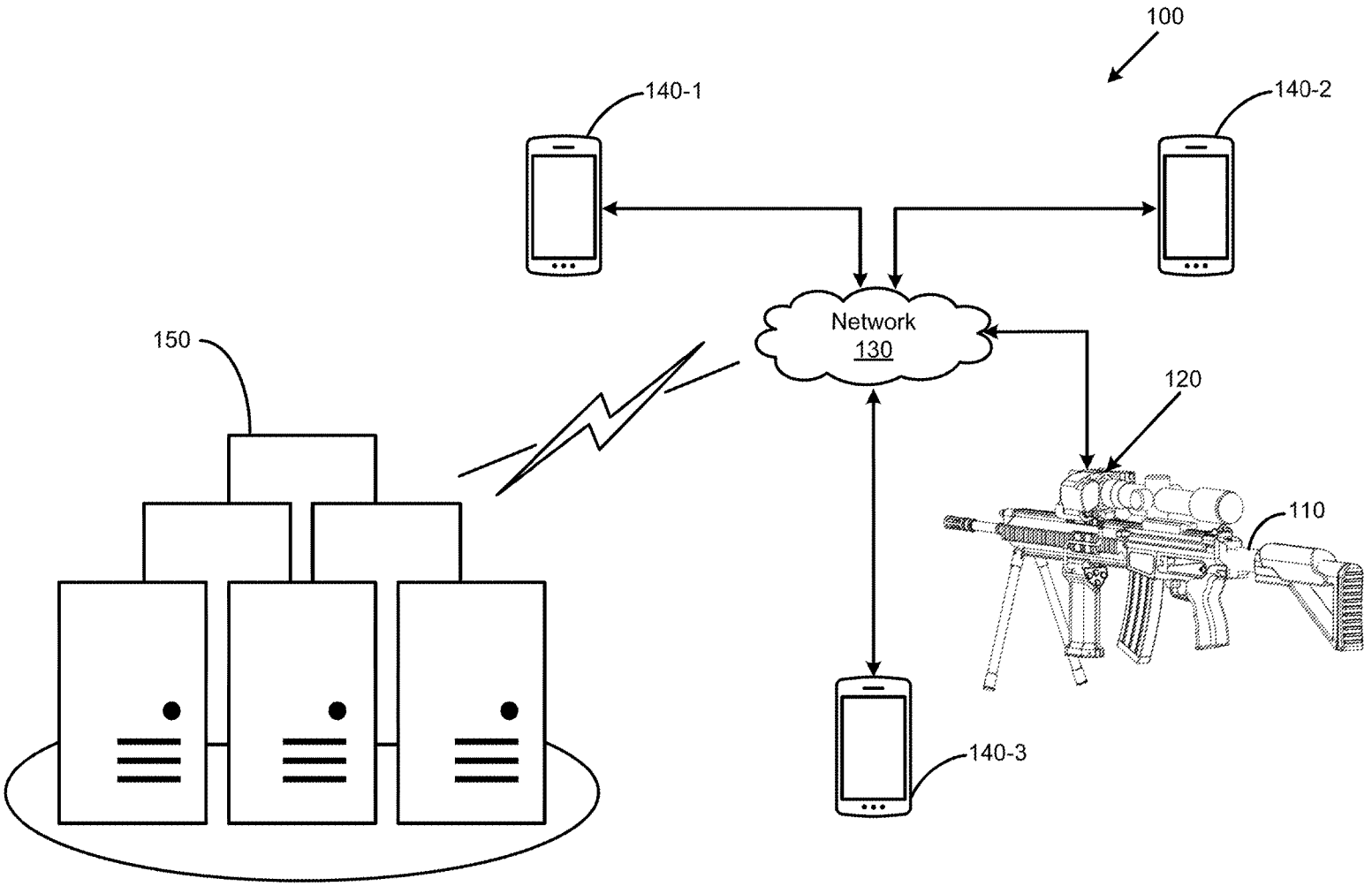
FIG. 1 illustrates a schematic representation of a military environment according to an embodiment of the present disclosure.

Referring to FIG. 1 illustrates a military environment 100 that includes elements for generating and assisting a shooter or a combat sniper to shoot a target. For example, the military environment is a simulation environment for training the combat sniper to shoot at the target at long ranges under different environmental conditions. The military environment 100 includes a weapon 110, a fire-control display adapter 120, a communication network 130, three spotter equipment 140-1, 140-2, 140-3, and a command center 150.

In the military environment 100, the combat snipers are entailed to work in close coordination with a spotter as part of a sniper team. The spotter provides protection and situational awareness for the sniper, since the sniper devotes substantial energy and attention to positioning the weapon for an effective shot. The spotter uses the spotter equipment 140, which carries all the imperative programs and hardware configuration to receive data from the fire-control display adapter 120. The spotter equipment then displays the data in a format, such that the spotter can understand and analyze the range to the target under different environmental conditions. After the analysis, the spotter then provides aiming information to the combat sniper via the communication network 130. The aiming information includes instructions to correctly orient the weapon 110 towards the target. In an example, the fire-control display adapter 120 is provided with cameras to relay live video feed to the spotter equipment 140 via the communication network 130. In another example, the fire-control display adapter 120 is connected with thermal imaging sensors mounted on the weapon 110, to relay live video feed to the spotter equipment 140 via the communication network 130. As used herein, the term "spotter equipment" may refer to a wireless device, a machine-to-machine (M2M) device, a mobile phone, a cellular phone, a Personal Digital Assistant (PDA) equipped with radio communication capabilities, a smartphone, a laptop or personal computer (PC) equipped with an internal or external mobile broadband modem, a tablet PC with radio communication capabilities, a portable electronic radio communication device, and/or an electronic device equipped with radio communication capabilities or the like for communicating with a sensor device. The sensor device may be any kind of weather sensor, such as wind, temperature, air pressure, humidity, etc. As further examples, the sensor may be a light sensor, an electronic or electric switch, a microphone, a loudspeaker, a camera sensor, etc.

In some embodiments, the sensor data is embedded into the video feed in accordance with governing standards and protocols. The standards are protocols are dependent on various jurisdictions. For example, a Motion Imagery Standards Board (MISB) standard 0601 is one such standard indicating how sensor data is embedded into the video (e.g., as a real-time, synchronous MISB key-length-value (KLV) stream). In some other embodiments, alternative standards may be used depending on desired functionality.

In addition to the above the fire-control display adapter 120 communicates with command center 150 via the communication network 130. For example, command center 150 refers to a central place for carrying out orders and for supervising tasks for the sniper team.

In some embodiments, the communication network 130 refers to a short-range communication network, for example, a Bluetooth™ communication network. In some embodiments, a specific distance of a preset communication distance may be set according to actual requirements, and the embodiments of the present application are not limited thereto. For example, in the case where the preset communication distance is 10 meters, the wireless communication network may be a Bluetooth™ communication network.

In some embodiments, the communication network 130 may refer to a long-range network that uses wireless data connections for connecting network nodes, for example, Wi-Fi access points, and enabling telecommunications between the network nodes. The cellular wireless communication network implements, for example, a long-term evolution (LTE) technology, and for purposes of illustration, is hereafter referred to as an "LTE network". Also, as used herein, "cellular wireless communication interface" refers to a wireless wide area network (WWAN) interface of the cellular wireless communication network between the display adapter 120 and the command center 150. For example, wireless communication works on a wireless communication technology that supports high-speed data transfer.

Figure 2:
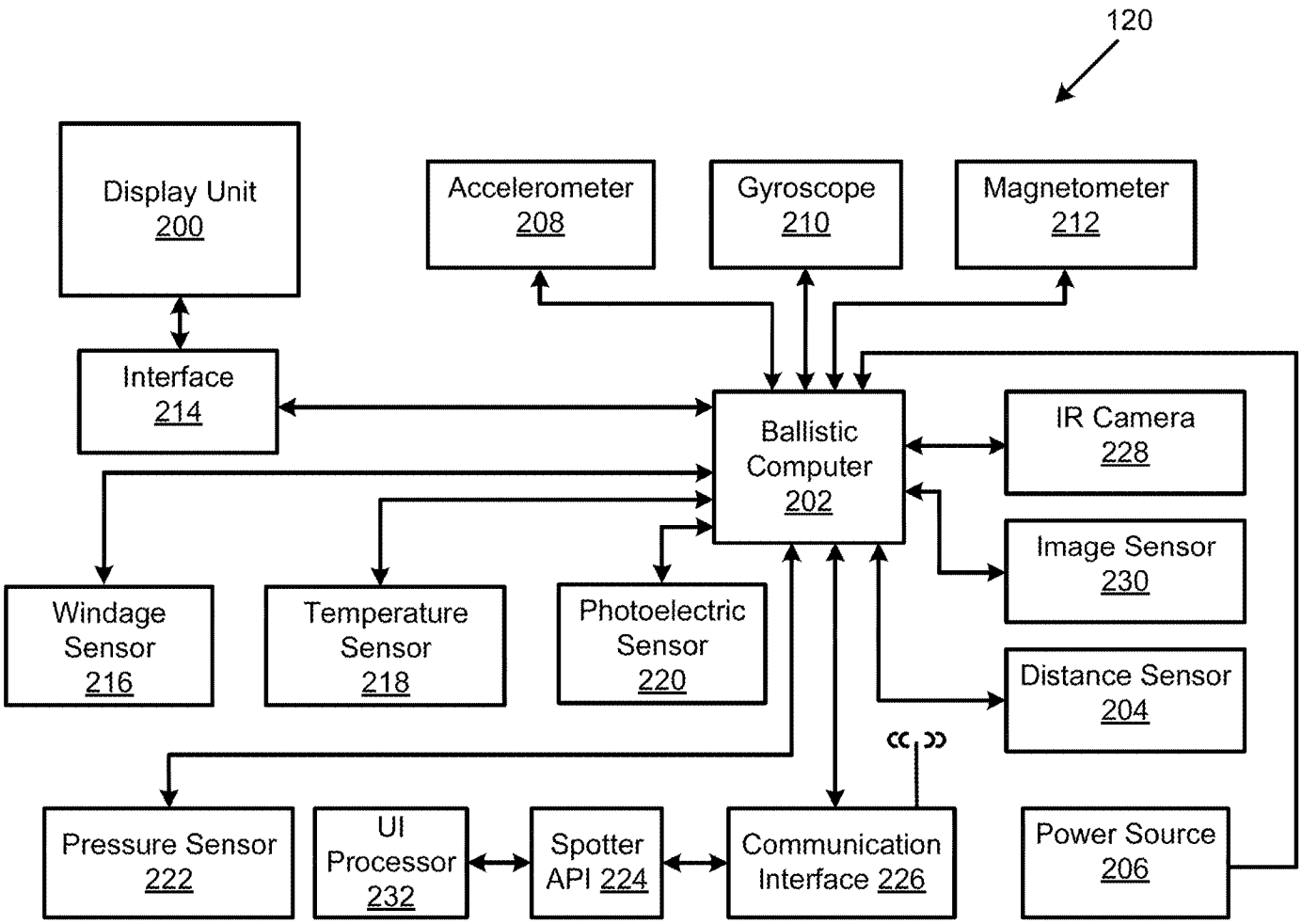
FIG. 2 illustrates a block diagram of a fire-control display adapter according to an embodiment of the present disclosure.

Referring to FIG. 2, illustrates a block diagram of the fire-control display adapter 120 as described in FIG. 1. The fire-control display adapter 120 includes a display unit 200, a ballistic computer 202, a distance sensor 204, a power source 206, an accelerometer 208, a gyroscope 210, a magnetometer 212, an interface 214, a windage sensor 216, and a temperature sensor 218, a photoelectric sensor 220, a pressure sensor 222, a spotter API 224, a communication interface 226, an infrared camera 228, an image sensor 230, and a user interface (UI) processor 232 or UI processor 232.

The term "ballistic computer" used herein refers to an electrical circuit or integrated circuit or circuit chip, in which the conductors are printed or deposited in predetermined patterns on an insulating substrate. In other words, the ballistic computer 202 is an integrated circuit that houses embedded circuitry that can transmit, receive, and process data received from multiple electronic components or devices. The ballistic computer 202 is in operable communication with an array of sensors, such as orientation sensors, range sensors, and environmental sensors. In some embodiments the sensors are selected from a group of the accelerometer 208, the gyroscope 210, the magnetometer 212, the windage sensor 216, the temperature sensor 218, the photoelectric sensor 220, the pressure sensor 222, the infrared camera 228, the image sensor 230, the distance sensor 204. In some embodiments, the distance sensor 204 is external to the fire control display adapter 120. In some embodiments, the sensors are communicably coupled to an external computer.

In some embodiments, the distance sensor 204 is selected from a group of an infrared rangefinder, a laser rangefinder, and an ultrasonic rangefinder. The distance sensor 204 senses a range to an aimpoint of a target. In some embodiments, the ballistic computer 202 is configured to process data associated with the orientation of fire control display adapter 120, process data associated with the orientation of the weapon 110, and calculate ballistic solutions. The ballistic computer 202 is communicably coupled to the display unit 200 and the distance sensor 204 to calculate a ballistic solution and cause the display unit 200 to display the ballistic solution. The ballistic computer 202 communicates with the display unit via interface 214. The display unit 200 is positioned at an objective bell of a scope and is aligned in front of an objective lens of the scope. In some embodiments, the display unit 200 is selected from a group of a liquid crystal display, a digital micromirror display, an organic light emitting diode display, and a quantum dot display. The power source 206 is communicably coupled to the ballistic computer 202 to provide power to the distance sensor 204 and the display unit 200.

In the embodiment illustrated, the ballistic computer 202 is communicatively coupled to control many of the other components. In some embodiments, the processing is further divided between sub-processors of the ballistic computer 202, which may include a rangefinder codec. The processing may be further consolidated or distributed, depending on desired functionality. Depending on desired functionality, the ballistic computer 202 may comprise one or more application-specific integrated circuit (ASIC), a field programmable gate array (FPGA), a general purpose processor, or the like. The UI processor 232 is communicatively coupled with the spotter API 224. In some embodiments, the UI processor 232 may be communicatively coupled with a wired or wireless interface, which can enable fire control display adapter 120 to communicate with another device. In some embodiments, a wireless interface or communication interface 226 is configured to enable communication between the ballistic computer 202 and a display device external to the fire-control display adapter 120. In some embodiments, wireless communication may be implemented via an IR interface. In some embodiments, communication may be implemented via wired communication, such as an RS252 serial port. The communication interface 226 is configured to transmit data from the ballistic computer 202 to an electronic device that is not mechanically coupled with fire control display adapter 120. In some embodiments, the electronic device is a display device operated at the command center disp 150. In some embodiments, the communication interface 226 is Bluetooth™ interface. In some other embodiments, the communication interface 226 is a Wi-Fi interface.

In operation, a sniper carrying the weapon 110 is entailed to switch on the ballistic computer 202 of the fire-control display adapter 120. For switching on the ballistic computer 202, power is entailed which comes from the power source 206. For example, the power source 206 is a battery positioned at a grip of the weapon 110. In another example, the power source 206 is an electrical connector to receive power from a source external to fire control display adapter 120. Once the ballistic computer 202 is switched on, the power is further transferred to all the electronic components, such as sub processors and the sensors of fire control display adapter 120.

The display unit 200 displays a range to the aimpoint of the target, where the laser range finder can transmit a laser beam through a transmission unit and receive a reflected laser beam through a receiver unit. The total time of the reflected laser beam is calculated by the ballistic computer 202 to determine the range to the aimpoint of the target. A variety of lasers with accompanying collimating optics may be used with the desired wavelength, diffraction, and other optical traits to enable range-finding and wind-sensing measurements at operating distances.

The display unit 200 displays the ballistic solution, in which the orientation of the weapon/and or fire control display adapter 120 is also displayed. Hence the accelerometer 208, the gyroscope 210, and the magnetometer 212 are activated by the ballistic computer 202 to identify parameters related to elevation, azimuth angles, tilt angles, and/or rotation ("cant") angles.

The display unit 200 further displays the ballistic solution based on environmental factors, such as wind, temperature, air pressure, and humidity. Since these environmental factors influence a bullet drop and horizontal targeting, the windage sensor 216, the temperature sensor 218, and the pressure sensor 222 calculate numerical values related to the environmental factors.

The range, parameters, and numerical values are automatically measured in real-time and may be overlayed as text or graphics on the objective lens of the scope. Further to this, the range, parameters, and numerical values are taken as inputs by the ballistic computer 202 to display the ballistic solution to the sniper through the ocular lens of the scope. The sniper can then align the weapon towards the virtual targeting reticle to go for an accurate shot.

In some cases, the sniper may be entailed to operate at night or in places with poor light conditions. In addition to this, there may come a requirement of relaying a live video feed of the location and surroundings of the target. For countering such hurdles the ballistic computer 202 uses the photoelectric sensor 220 to determine activating either the infrared camera 228 or the image sensor 230, for example, a video camera. For example, the photoelectric sensor 220 indicates a low-light condition, then the infrared camera 228 is activated as the infrared camera 228 measures temperatures of object surfaces and functions on infrared thermography. The infrared thermography is a passive imaging method for contactless temperature measurement. In another example, the photoelectric sensor 220 indicates optimal lighting conditions for recording scenes for the live video feed, in such case the image sensor 230 is activated to record the scenes. In one scenario, a combination of thermal and night vision technologies may be entailed to be used in tandem in order to optimize sighting pictures in all environments and scenarios. In such cases both the infrared camera 228 and the image sensor 230 can be activated by the ballistic computer 202 at the same time to perform the infrared thermography and the videography simultaneously. For this, ballistic computer 202 may be provided with such instruction via the UI processor 232. The UI processor 232 enables the functioning of instructions received from a device carrying the user interface for operating the ballistic computer 202. The device may be the spotter equipment 140-1, 140-2, or 140-3. In some embodiments, the ballistic computer 202 is manually operated by input units or buttons or switches positioned on the display adapter. In some embodiments, ballistic computer 202 is controlled by the spotter equipment 140-1, 140-2, 140-3, and/or the command center 150 of FIG. 1.

The fire control display adapter 120 is mounted on the rail of the weapon 110 such that the display unit 200 works in tandem with accessories or sensors mounted on the weapon 110. The sensors may include imaging sensors, including but not limited to thermal, night vision, mid-wave, and complementary metal-oxide semiconductors). In some embodiments, a magnified liquid crystal display or a viewfinder display is clipped side by side on the eyepiece 308 of the scope 300 with the same eye relief and focal point to the eye when operating the scope 300.

In some embodiments, a live video feed from the image sensors mounted on the weapon 110, is relayed on the display unit 200, where the live video feed is overlayed with all related targeting information at sides and top areas (range, cant, elevation, azimuth, wind speed, hold values, and ballistic parameters. In some embodiments, the ballistic computer 202 is configured to process images from the live video feed to reduce image tear due to weapon movements and display an electronic aimpoint on the target scene. In some embodiments, the ballistic computer 202 is configured to reduce scintillation blur and track a target for lead angles and tracking. An accurate aimpoint is then displayed on display unit 200. Such arrangements eliminate the need to automatically adjust a text font size proportional to a zoom level of the scope 300. The sniper no longer needs to manually re-adjust the text font size of the display unit 200 to the zoom level of the scope. This reduces target engagement time and allows rapid updates and timely shots to the target.

As described above, the spotter equipment 140-1, 140-2, 140-3 may communicate with the ballistic computer 202, where the spotter API 224 receives the instructions from the spotter equipment 140-1, 140-2, 140-3, which are processed by the UI processor 232 and are further transmitted to the ballistic computer 202. The spotter API 224 defines a protocol for communicating information related to control operations by the spotters and between the spotter equipment 140-1, 140-2, 140-3, and the ballistic computer 202. The API refers to a software interface that provides a means for a software application or a client application (e.g., the spotter equipment 140-1, 140-2, 140-3, or the command center 150) to communicate with a remote application, installed the spotter equipment 140-1, 140-2, 140-3 or the command center 150 over, a network (e.g., the Internet) through a series of programming commands that call and/or invoke a routine to execute a specific process. In some embodiments, the API may communicate back and forth between the spotter equipment 140-1, 140-2, 140-3, and the ballistic computer 202. In some embodiments, the API uses a secured tunnel. The secured tunnel is a communication link that is encrypted and is used to transmit and receive data over an encrypted connection. The encrypted connection helps to maintain the privacy of control operations.

Figure 3:
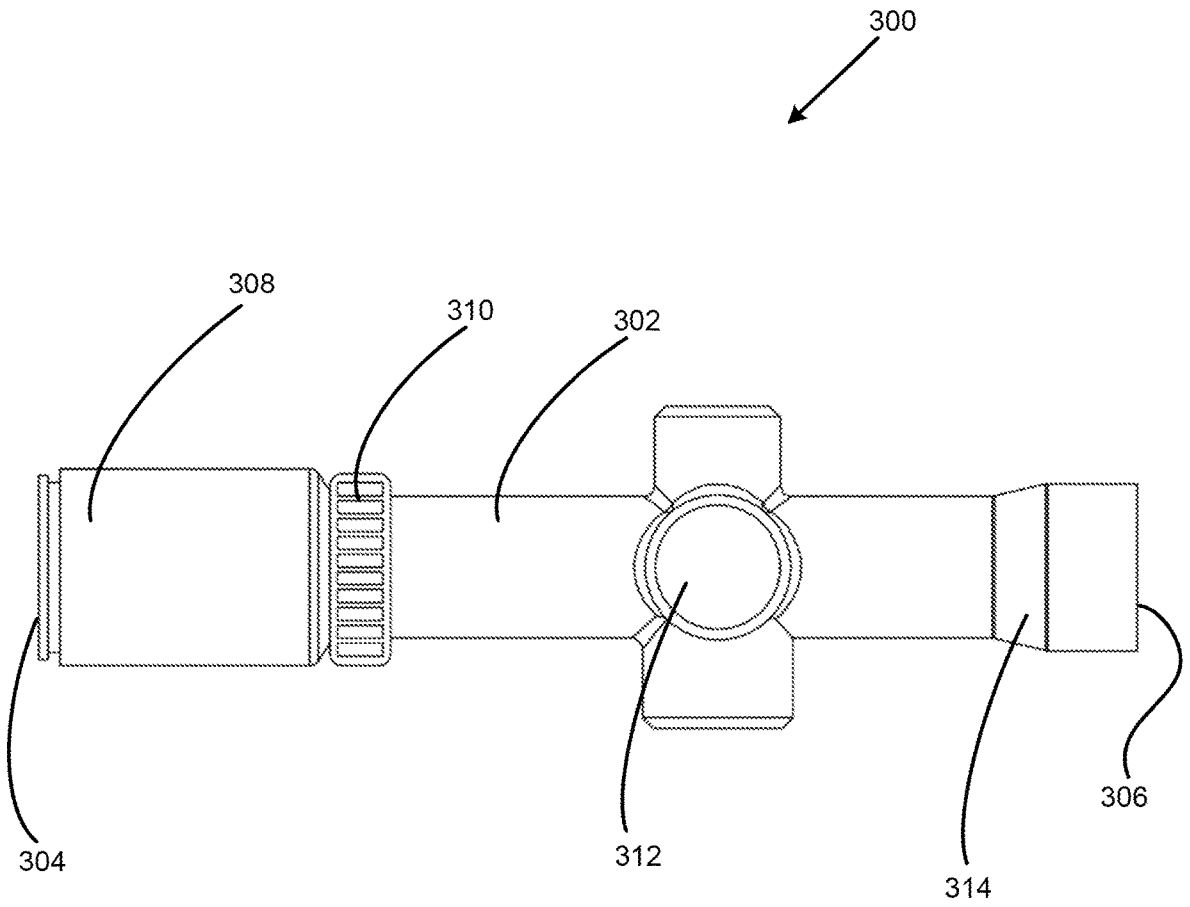
FIG. 3 illustrates a top view of the scope of the weapon according to an embodiment of the present disclosure.

Referring to FIG. 3 illustrates a top view of a scope 300 of the weapon 110 according to an embodiment of the present disclosure. The scope 300 is illustrated without fire control display adapter 120. The scope 300 comprises a tube 302 that primarily includes an ocular lens 304, and an objective lens 306. The ocular lens 304 is positioned at the rear end of the tube 302 and is housed in an eyepiece 308. The eyepiece 308 is designed to allow a sniper to view an image produced by the scope 300. The objective lens 306 is positioned at the front end of the tube 302 and is connected to a power ring 310.

The power ring 310 is operably coupled to an objective bell 314 of the scope. The objective bell 314 houses objective lens 306. The power ring 310 enables the sniper to adjust the magnification level of the scope 300. The power ring 310 comprises a knob that the sniper can rotate to increase or decrease the magnification of the scope. The ocular lens 304 is connected to an elevation knob 312, which is designed to adjust the elevation settings of the scope 300. The elevation knob comprises a dial that the sniper can rotate to adjust the scope's vertical position.

Figure 4A:
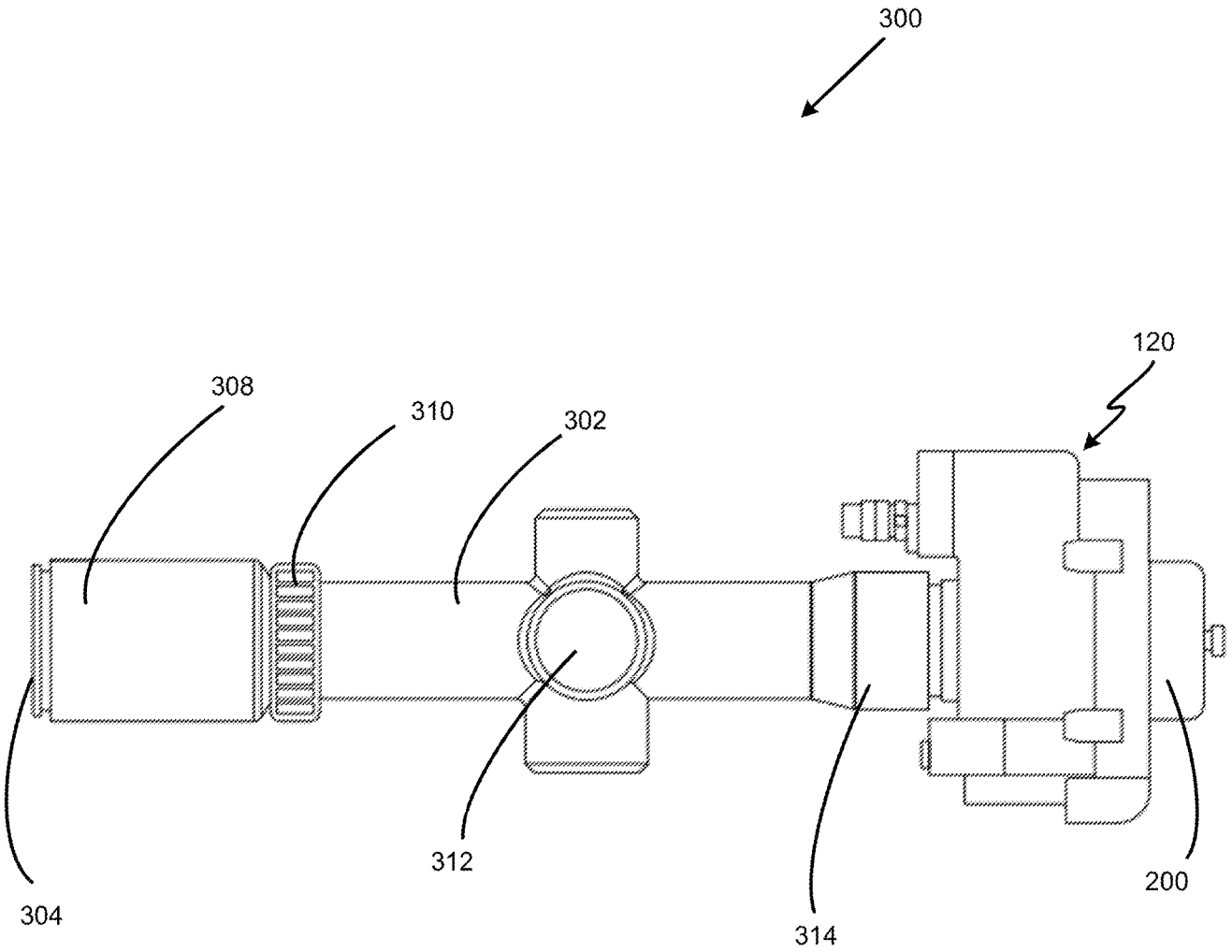
FIG. 4A illustrates a top view of the fire-control display adapter mounted on the scope of the weapon according to an embodiment of the present disclosure.

Referring to FIG. 4A illustrates a top view of fire control display adapter 120 mounted on the scope 300 of the weapon 110 according to an embodiment of the present disclosure.

The fire control display adapter 120 is positioned towards the end of the scope that has the objective lens 306. Due to such positioning of the fire control display adapter 120, the display unit 200 is positioned at the objective bell 314 of the scope 300 and is aligned in front of the objective lens 306 of the scope 300. In some embodiments, the display unit 200 has a circular shape with a diameter range from 30 mm to 60 mm. In some embodiments, the diameter of the display unit 200 a range from 35 mm to 55 mm. In some embodiments, the diameter of the display unit 200 is in a range from 40 mm to 50 mm. In some embodiments, the diameter of the display unit 200 is 45 mm.

In some embodiments, the fire control display adapter 120 comprises an attachment portion for releasably mounting the fire control display adapter 120 to the scope 300 of the weapon 110. In some embodiments, the attachment portion includes a mounting mechanism configured to releasably engage the tube 302 of the scope 300. In some embodiments, the mounting mechanism is selected from a group consisting of a clasp, a clamp, a hook and loop fastener, a tie wrap, and a magnet.

Figure 4B:
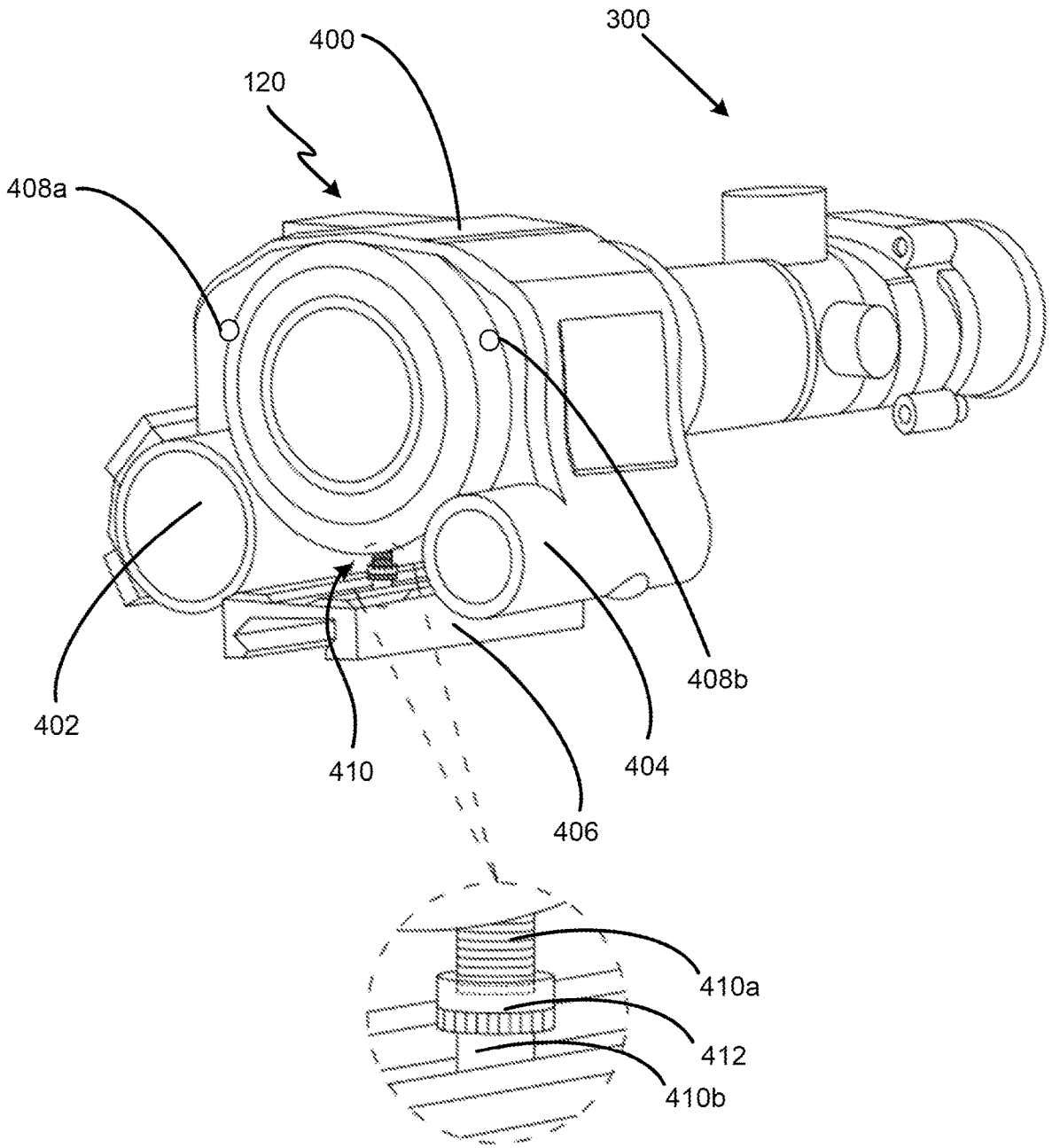
FIG. 4B-4C illustrate side views of the fire-control display adapter mounted on the scope of the weapon according to an embodiment of the present disclosure.
Figure 4C:
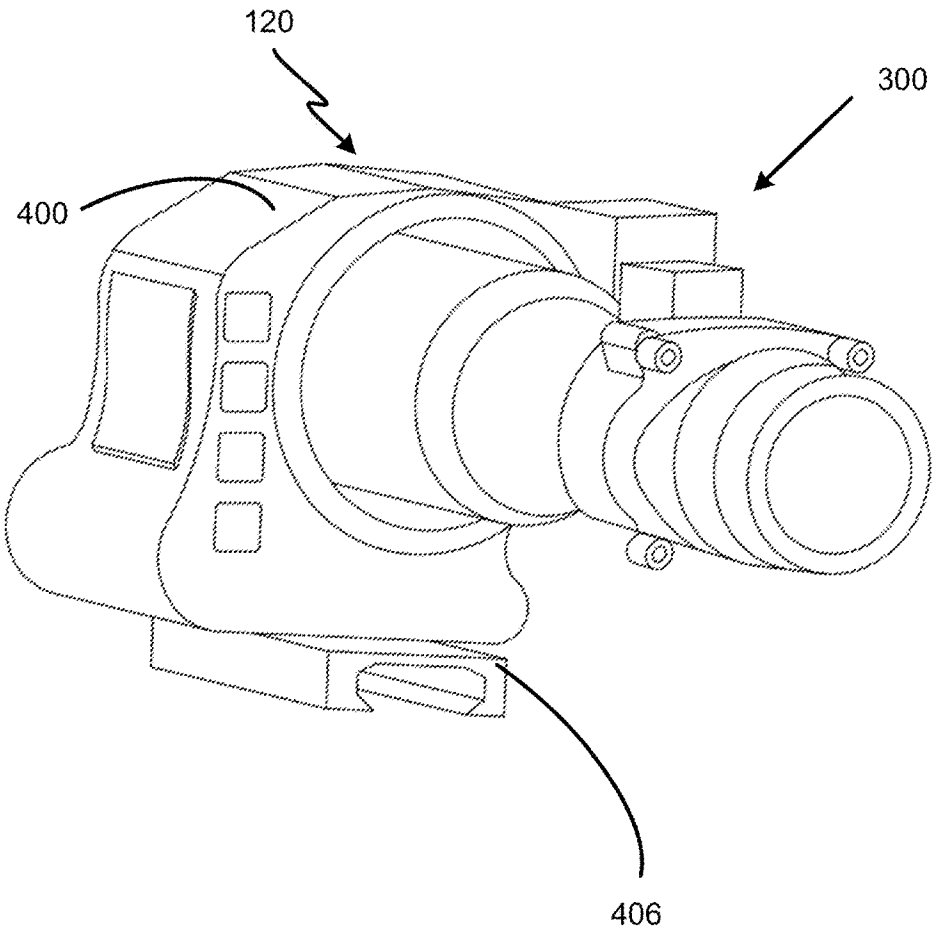

Referring to FIG. 4B and FIG. 4C illustrates side views of the fire control display adapter 120 mounted on the scope 300 of the weapon 110 according to an embodiment of the present disclosure.

As shown in FIG. 4B, the fire control display adapter 120 comprises a portion 400 that includes the display unit 200. When fielded, the objective bell 314 of the scope 300 is positioned inside the portion 400 to align the objective lens 306 and the display unit 200 in front of each other. The fire control display adapter 120 further comprises a second portion 402, which houses a transmission unit of the laser range finder 204. The fire control display adapter 120 further comprises a third portion 404, which houses a receiver unit of the laser range finder 204. The fire control display adapter 120 further comprises a mount 406 to detachably secure the fire control display adapter 120 on a rail of the weapon 110.

The fire control display adapter 120 further comprises an infrared range sensor to determine a distance between two targets. The IR range sensor is communicably coupled to the ballistic computer 202 and performs continuous emission of an infrared beam by an infrared light emitting diode 408*a* onto a first target and a second target. The emitted infrared beam is reflected by the first target and second target, and the reflection is detected by a photocell 408*b* sensitive to an infrared beam. Further based on the principle of triangulation, the distance between the first target and the second target is determined.

As shown in FIG. 4B and FIG. 4C, the mount 406 includes an adjuster 410 to adjust the fire-control display adapter 120. The adjuster is positioned between the mount 406 and the portion 400. The adjuster 410 performs vertical adjustment of the fire control display adapter 120 with respect to the rail of the weapon 110 and/or with respect to an optical path and/or an ocular lens 304 of the scope 300. The adjuster 410 comprises a first bolt 410*a*, a second bolt 410*b*, and a ring 412. A lateral surface of the first bolt 410*a* is provided with threads. The ring is 412 is fixed on top of the second bolt 410*b*. An inside surface of the ring 412 is provided with other threads. A first end of the first bolt 410*a* is removably attached to the scope 300 and a first end of the second bolt 410*b* is attached to the mount 406. A second end of the first bolt 410*a* is covered by the ring 412.

In use, the sniper can rotate the ring 412 to either bring together the first bolt 410*a* and the second bolt 410*b* or move the first bolt 410*a* and the second bolt 410*b* away from each other. Such movement of the first bolt 410*a* and the second bolt 410*b* enables vertical adjustment of the fire control display adapter 120 with respect to the rail of the weapon 110.

In some embodiments the adjuster 410 function on a differential screw arrangement. In some embodiments, the adjuster 410 function on a wedging mechanism.

Figure 5A:
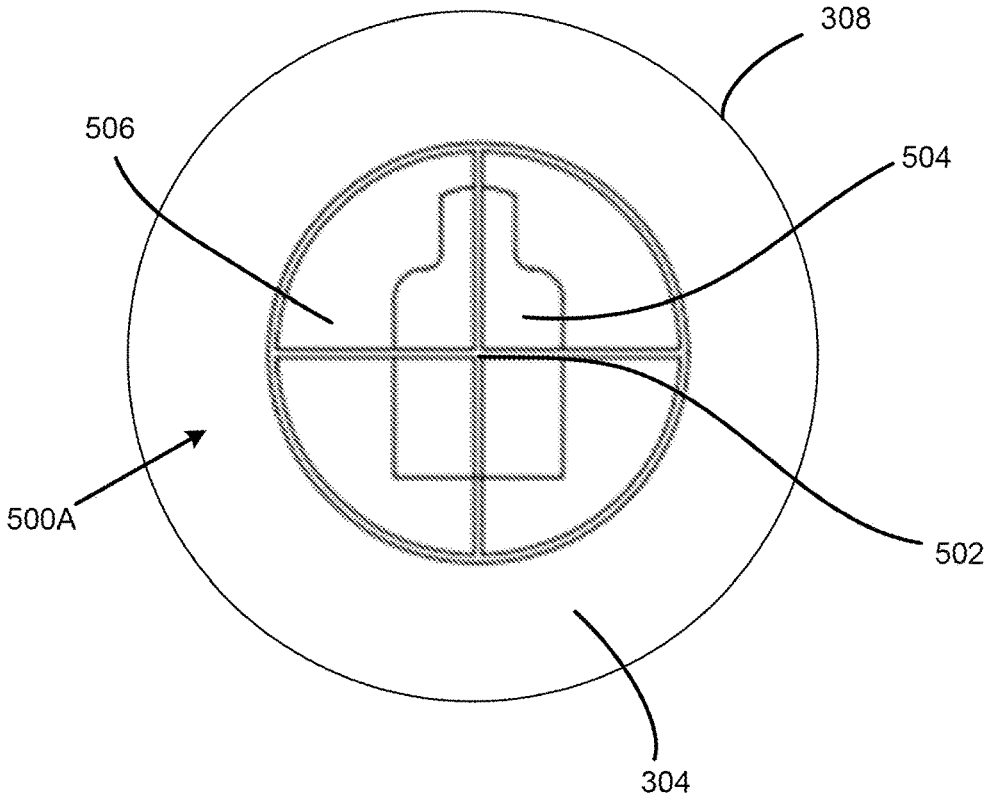
FIG. 5A-5B illustrate schematic views of a display unit according to an embodiment of the present disclosure.
Figure 5B:
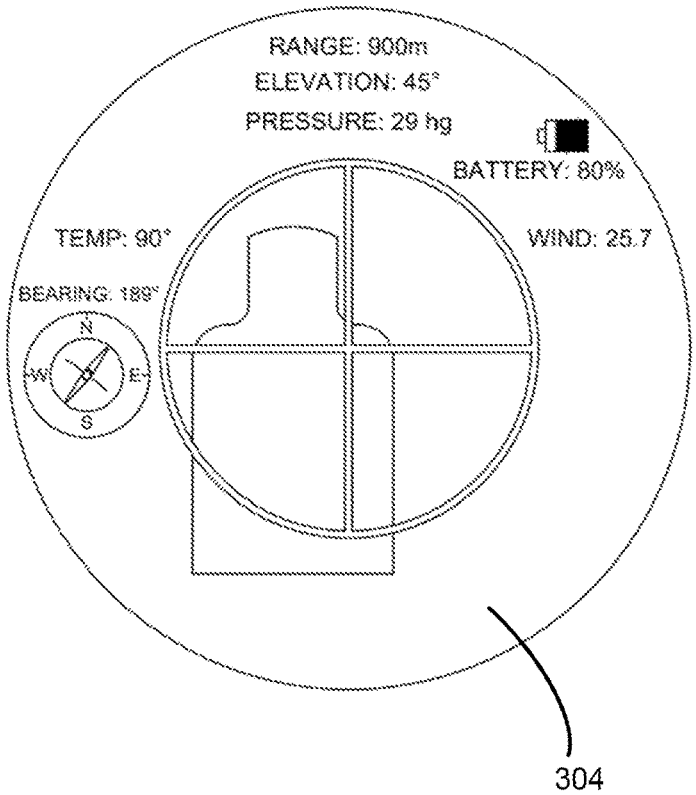

Referring to FIG. 5A and FIG. 5B, illustrate schematic views of the display unit 200 working in tandem with the ocular lens 304 of the scope 300 according to an embodiment of the present disclosure. FIG. 5A shows an example view 500A provided by scope 300. View 500A shows a view of a long-range target area as seen through scope 300 prior to mounting In some embodiments. Shooting accurately at long ranges is not as simple as lining up a crosshair 502 at the center of target 504 in the target area 506. For example, the environment between scope 300 and target area 506 may include strong left crosswinds. Additionally, long-range shots need to take the effect of gravity into account, which causes a shot to drop between the weapon and the target area 506. A magnetic heading of the weapon may also affect long-range shots. A shot taken under these circumstances would drop and may lead to an inaccurate shot because of the strong crosswind and effect of gravity over a long distance to the target area 506. The sniper could approximate the aimpoint based on an estimation of the strength of the left cross-wind and the distance to the target area 506. The sniper could then use the aimpoint by manually aligning the crosshair 502 above and to the left of the target 504.

As shown in FIG. 5B, to accurately hit the target in the target area 506 when using the scope 300, the sniper would need to approximate the aimpoint above and to the left of the target 504. The shooter could approximate the aimpoint based on an estimation of the strength of the left cross-wind and the distance to the target area 506. The sniper could then use the aimpoint by manually aligning the crosshair above and to the left of the target 504.

Figure 6:
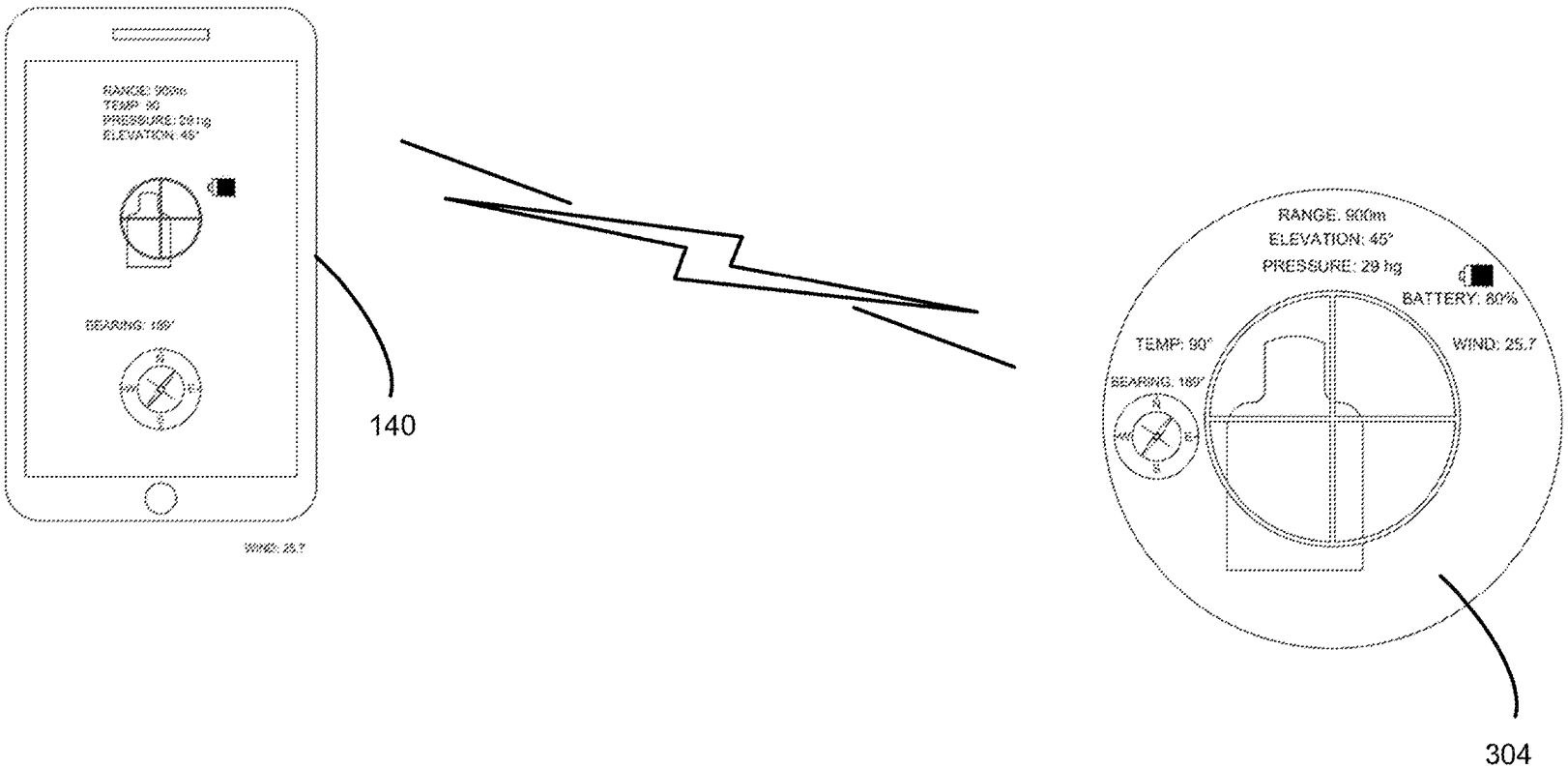
FIG. 6 illustrates a schematic representation of a screen mirroring of the display unit on spotter equipment according to an embodiment of the present disclosure.

Referring to FIG. 6, illustrates a schematic representation of a screen mirroring of the display unit 200 on the spotter equipment 140 according to an embodiment of the present disclosure. The sniper can use an assisting spotter to use a ballistic computer in conjunction with the display unit 200 and connected via the communication network. Here the spotter could simultaneously analyse windage, elevation, azimuth angles, tilt angles, and/or rotation ("cant") angles in real time and instruct the sniper to orient the weapon 110 in a particular direction or order.

In use, the ballistic computer 202 processes data and calculates a ballistic solution. The communication interface 226 transmits the ballistic solution data to be displayed on the spotter equipment 140.

Figure 7:
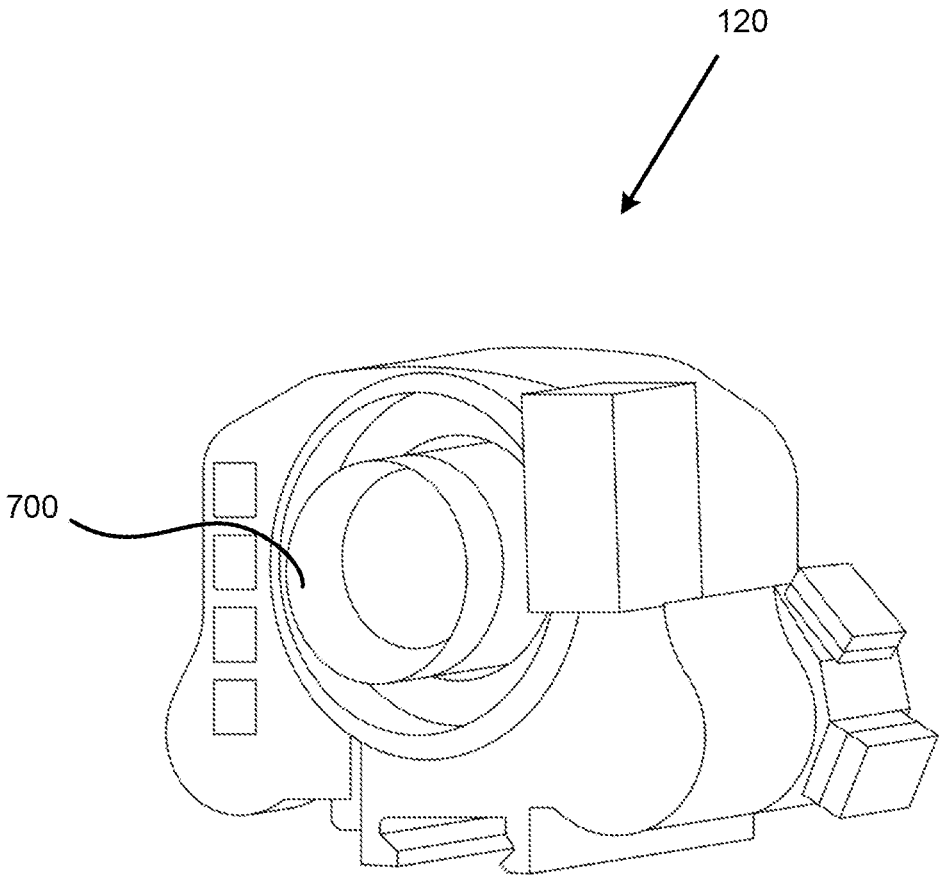
FIG. 7 illustrates a perspective view of the display adapter according to an embodiment of the present disclosure.

Referring to FIG. 7, illustrates a perspective view of the fire control display adapter 120 according to an embodiment of the present disclosure. The fire control display adapter 120 further comprises a sealing ring 700 detachably coupled to the fire control display adapter 120.

In some embodiments, the sealing ring 700 has a circular periphery with an inside diameter in a range from 30 mm to 60 mm. In some embodiments, the sealing ring 700 has a circular periphery with an inside diameter in a range from 35 mm to 55 mm. In some embodiments, the sealing ring 700 has a circular periphery with an inside diameter in a range from 40 mm to 50 mm. In some embodiments, the diameter of the sealing ring 700 is 45 mm. The sealing ring 700 is structured such that a circular periphery form fits an outer periphery of the objective bell 314.

In some embodiments, the sealing ring 700 is made of an elastomer. In some other embodiments, the sealing ring 700 is made of a magnesium alloy.

Figure 8:
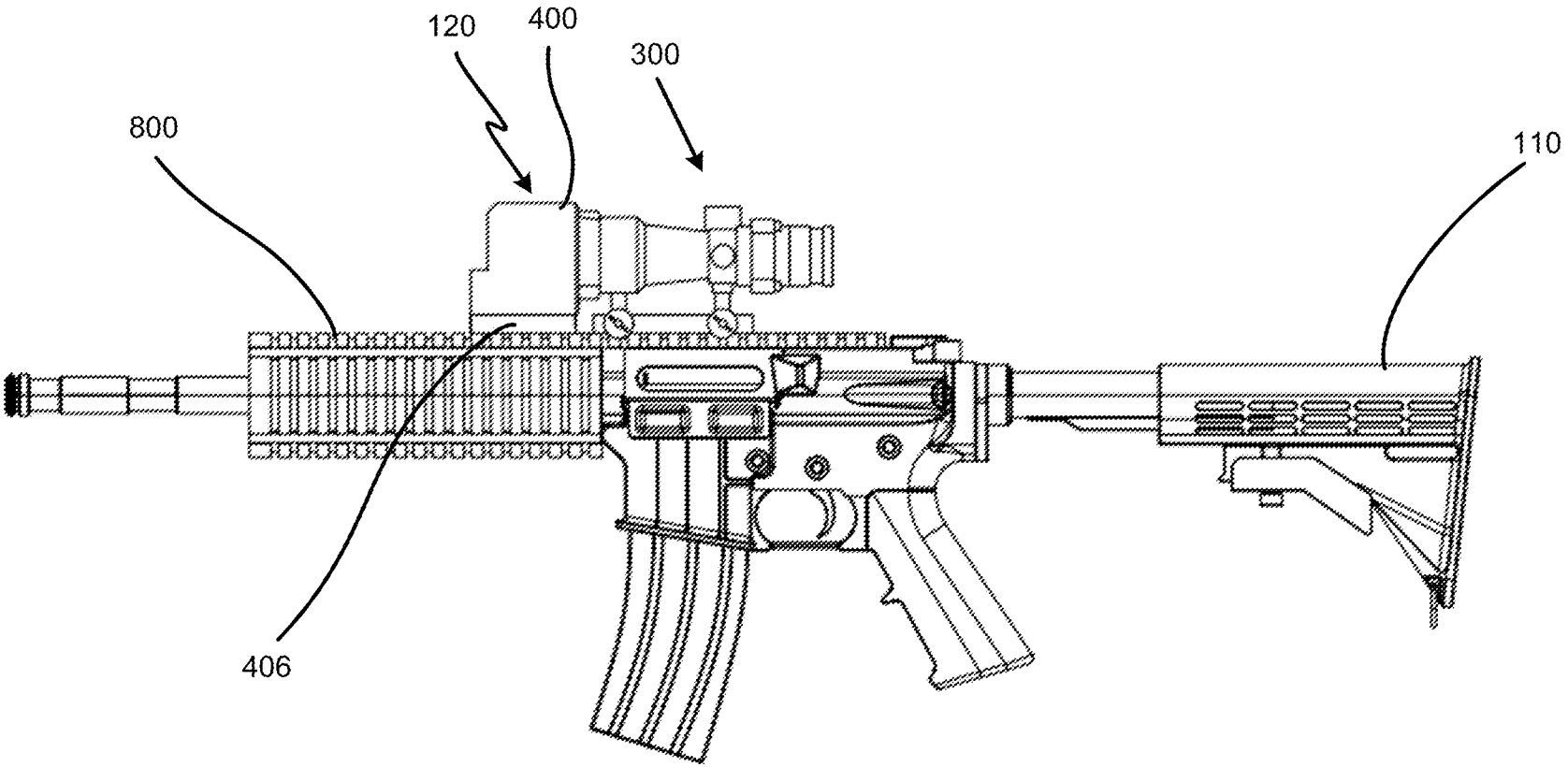
FIG. 8 illustrates a side view of the fire-control display adapter according to an embodiment of the present disclosure.

Referring to FIG. 8, illustrates a side view of the fire control display adapter 120 mounted on the weapon 110 according to an embodiment of the present disclosure. The fire control display adapter 120 comprises the adjuster (not shown) arranged between the surface of the mount 406 and the portion 400 to adjust the fire control display adapter 120 with respect to the optical path and/or the ocular lens 304. Further the mount 406 is slidably moves on a rail 800 of the weapon 110 to attach the fire control display adapter 120 to the weapon 110. The fire control display adapter 120 is attached to the weapon such that the display unit (not shown) is aligned in front of objective lens of the scope 300. For example, the rail 800 is one of a Picatinny rail and a weaver rail. In some embodiments, the adjuster comprises a coupling mechanism that includes a bolt and a nut.

An engagement between the adjuster 410 and the scope 300 can be adjusted according to the size of the tube 302 and according to the size of the eyepiece 308 or objective bell 314, as different scopes may have different dimensions and configurations. For example, scope 300 has a rectangular shape. In another example, scope 300 has a circular shape. In yet another example, the scope 300 has a square shape.

The present embodiments described herein related to the fire control display adapter 120 enables the sniper to shoot at a target without considering text font size. Further, the retrofitting feature of the display adapter enables the display adapter to be mountable on various traditional scopes.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a swim diagram, a data flow diagram, a structure diagram, or a block diagram. Although a depiction may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data.

While the principles of the disclosure have been described above in connection with specific apparatuses and methods, it is to be clearly understood that this description is made only by way of example and not as limitation on the scope of the disclosure.

We claim:

1. A fire-control display adapter for a scope of a weapon, the fire-control display adapter comprising:
- a display unit:
  - positioned at an objective bell of the scope, and
  - aligned in front of an objective lens of the scope;
  - a distance sensor to sense a range to an aimpoint of a target;
  - a ballistic computer communicably coupled to the display unit and the distance sensor to:
    - calculate a ballistic solution; and
    - cause the display unit to display the ballistic solution;
  - a power source communicably coupled to the ballistic computer to provide power to the distance sensor and the display unit; and
  - a mount to detachably affix the fire-control display adapter on a rail of the weapon, the mount including a first bolt, a second bolt, and a ring, wherein a rotational movement of the ring causes a relative movement between the first bolt and the second bolt to adjust the fire-control display adapter vertically with respect to the rail of the weapon.

2. The fire-control display adapter for the scope of the weapon as claimed in claim 1, wherein the display unit is selected from a group of a liquid crystal display, a digital micromirror display, an organic light emitting diode display, and a quantum dot display.

3. The fire-control display adapter for the scope of the weapon as claimed in claim 1, wherein the distance sensor is selected from a group of an infrared rangefinder, a laser rangefinder, and an ultrasonic rangefinder.

4. The fire-control display adapter for the scope of the weapon as claimed in claim 1, the fire-control display adapter further comprising a sealing ring detachably coupled to the display unit.

5. The fire-control display adapter for the scope of the weapon as claimed in claim 1, the fire-control display adapter further comprising a plurality of sensors communicably coupled to the ballistic computer, the plurality of sensors being selected from a group of a gyroscope, a magnetometer, an accelerometer, a windage sensor, a temperature sensor, a photoelectric sensor, and a pressure sensor.

6. The fire-control display adapter for the scope of the weapon as claimed in claim 1, wherein the display unit has a circular shape with a diameter in a range from 30 mm to 60 mm.

7. The fire-control display adapter for the scope of the weapon as claimed in claim 1, wherein the rail is one of a Picatinny rail and a weaver rail.

8. The fire-control display adapter for the scope of the weapon as claimed in claim 1, wherein the fire-control display adapter further comprising a wireless interface to enable communication between the ballistic computer and a display device external to the fire-control display adapter.

9. The fire-control display adapter for the scope of the weapon as claimed in claim 1, wherein the power source is an electrical connector to receive power from a source external to the fire control display adapter.

10. The fire-control display adapter for the scope of the weapon as claimed in claim 1, wherein the mount includes an adjuster to adjust the fire-control display adapter vertically with respect to the rail of the weapon.

11. A fire-control display adapter for a scope of a weapon, the fire-control display adapter comprising:
- a display unit:
  - positioned at an objective bell of the scope, and
  - aligned in front of an objective lens of the scope;
  - a distance sensor to sense a range to an aimpoint of a target;
  - a ballistic computer communicably coupled to the display unit and the distance sensor to:
    - calculate a ballistic solution; and
    - cause the display unit to display the ballistic solution;
  - a power source communicably coupled to the ballistic computer to provide power to the distance sensor and the display unit; and
  - a mount to detachably affix the fire-control display adapter on a rail of the weapon, the mount including:
    - an adjuster to adjust the fire-control display adapter vertically with respect to the rail of the weapon, wherein:
      - the adjuster is comprised of a ring engaged with at least one threaded element, and
      - rotational movement of the ring causes adjustment between the fire-control display adapter vertically with respect to the rail of the weapon.

12. The fire-control display adapter for the scope of the weapon as claimed in claim 11, wherein the distance sensor is selected from a group of an infrared rangefinder, a laser rangefinder, and an ultrasonic rangefinder.

13. The fire-control display adapter for the scope of the weapon as claimed in claim 11, the fire-control display adapter further comprising a sealing ring detachably coupled to the display unit.

14. The fire-control display adapter for the scope of the weapon as claimed in claim 11, the fire-control display adapter further comprising a plurality of sensors communicably coupled to the ballistic computer.

15. The fire-control display adapter for the scope of the weapon as claimed in claim 11, wherein the rail is one of a Picatinny rail and weaver rail.

16. The fire-control display adapter for the scope of the weapon as claimed in claim 11, wherein the adjuster comprises a coupling mechanism that includes a bolt and a nut.

17. A fire-control display adapter for a scope of a weapon, the fire-control display adapter comprising:

a display unit:

positioned at an objective bell of the scope, and aligned in front of an objective lens of the scope;

a sealing ring detachably coupled to the display unit;

a distance sensor to sense a range to an aimpoint of a target;

a ballistic computer communicably coupled to the display unit and the distance sensor to:

calculate a ballistic solution; and cause the display unit to display the ballistic solution;

a power source communicably coupled to the ballistic computer to provide power to the distance sensor and the display unit;

a mount to detachably affix the fire-control display adapter on a rail of the weapon; and a ring to adjust vertically with a rotational movement of the ring distance between the fire-control display adapter with respect to the rail of the weapon.

18. The fire-control display adapter for the scope of the weapon as claimed in claim 17, wherein the display unit has a circular shape.

19. The fire-control display adapter for the scope of the weapon as claimed in claim 17, wherein the power source is an electrical connector to receive power from a source external to the display adapter.

20. The fire-control display adapter for the scope of the weapon as claimed in claim 17, wherein the mount includes an adjuster to adjust the fire-control display.

* * * * *